US007140172B2

(12) United States Patent
Artzt et al.

(10) Patent No.: US 7,140,172 B2
(45) Date of Patent: Nov. 28, 2006

(54) COVERING FOR DRAFTING ROLLERS

(75) Inventors: Peter Artzt, Reutlingen (DE); Larisa Ausheyks, Aichwald (DE); Theo Grün, Köngen (DE)

(73) Assignee: Deutsche Instistute fur Textil-und Faserforschung Stuttgart Stiftung des offentlichen Rechts, Denkendorf (DE)

( * ) Notice: Subject to any disclaimer, the term of this patent is extended or adjusted under 35 U.S.C. 154(b) by 0 days.

(21) Appl. No.: 10/539,182

(22) PCT Filed: Dec. 17, 2003

(86) PCT No.: PCT/EP03/14369

§ 371 (c)(1),
(2), (4) Date: Jun. 16, 2005

(87) PCT Pub. No.: WO2004/057072

PCT Pub. Date: Jul. 8, 2004

(65) Prior Publication Data

US 2006/0075738 A1 Apr. 13, 2006

(30) Foreign Application Priority Data

Dec. 19, 2002 (DE) ..... 102 60 025

(51) Int. Cl.
*D01H 5/74* (2006.01)

(52) U.S. Cl. ..... 57/404; 57/315

(58) Field of Classification Search ..... 57/404–417; 492/57, 48, 16; 19/258–295
See application file for complete search history.

(56) References Cited

U.S. PATENT DOCUMENTS

| | | | | |
|---|---|---|---|---|
| 1,456,458 | A | 5/1923 | Nordell | |
| 1,749,393 | A * | 3/1930 | Pflimlin | 492/57 |
| 2,948,024 | A * | 8/1960 | Swanson | 19/295 |
| 5,451,197 | A * | 9/1995 | Grant | 492/16 |
| 6,390,962 | B1 * | 5/2002 | Birkenmaier et al. | 492/57 |
| 2001/0018823 | A1 | 9/2001 | Dinkelmann et al. | |

FOREIGN PATENT DOCUMENTS

| | | |
|---|---|---|
| DE | 1888549 | 2/1964 |
| DE | 1685634 | 3/1972 |
| GB | 643666 | 9/1950 |
| GB | 1253155 | 11/1971 |
| NL | 42235 | 3/1935 |

OTHER PUBLICATIONS

German Patent Office Search Report, May 2, 2003.
PCT Search Report, Apr. 29, 2004.

* cited by examiner

*Primary Examiner*—Shaun R. Hurley
(74) *Attorney, Agent, or Firm*—Dority & Manning

(57) ABSTRACT

A spinning machine drafting device includes a pressure roller loaded against a lower roller such that a fiber structure is conveyed between the roller pair. The pressure roller has an outer circumferential layer disposed around an inner circumferential layer of different low friction material as compared to the outer layer. The outer layer is thinner than the inner layer and disposed around the inner layer so as to slide relative to the inner layer upon rotation of the pressure roller in operation of the drafting device.

25 Claims, 3 Drawing Sheets

COVERING FOR DRAFTING ROLLERS

FIELD OF THE INVENTION

The invention relates to a roller drafting device for spinning machines in which the covering for the pressure rollers consists of an outer and an inner layer and the outer layer has a thinner wall than the inner layer, as well as to a belt or casing for use as a covering for pressure rollers in such drafting devices for spinning machines in which the thinner-walled outer layer loosely surrounds the thicker inner layer so that the outer layer can move relatively to the inner layer.

BACKGROUND

During the drafting of fiber bands in drafting devices, the clamping action of the roller pairs plays a decisive part for the transfer of the drafting forces onto the fiber band. The roller pairs of the drafting device therefore consist of a fluted steel cylinder, the so-called lower cylinder, and of a pressure roller, the so-called upper roller, that is pressed by load onto the steel cylinder. As a rule, this pressure roller comprises an elastic covering so that no clamping line is produced but rather a clamping surface formed by the deformation of the elastic covering, which surface brings about a significantly better fiber retention. A good clamping action is exerted on the fiber structure without damaging the fibers. Experience has shown that soft roller coverings therefore yield better drafting results since the softer the covering is, the greater is the clamping surface. However, soft roller coverings have the disadvantage that they wear down very rapidly and that grooves are produced in particular in the area of the fiber passage. This so-called "shrinking" is eliminated by buffing over the entire covering surface. This alters the geometry of the drafting device rollers and therewith also the covering properties, which for its part has a disadvantageous effect on the drafting conditions and thus on the yarn values. In addition, the regrinding of the roller coverings is a quite expensive measure.

The attempt has therefore already been made to counteract this disadvantage by means of a multi-layer roller covering. DE 1 815 739 U teaches a pressure roller whose elastic jacket is subdivided into at least two layers of which the outer layer is designed as an elastic casing consisting of a thin hose that can be drawn over the elastic jacket of the pressure cylinder. The designing of the outer layer as a hose makes it easy to draw a cover over the elastic jacket and also to easily remove it from the latter when this outer circumferential surface has become worn. The fixing of the elastic hose is ensured by the natural friction between rubber and rubber. This known design does make it possible to readily replace the elastic outer layer; however, it was not able to solve the problem of the rapid wear and of the shrinking.

DE 1 685 634 A1 teaches a covering for drafting device rollers of spinning machines which covering is composed of two superposed cylindrical layers of which the outer layer is harder and has a thinner wall than the inner layer. The two layers are adhered to one another. As a result thereof, very different materials can be combined with each other in order to avoid the formation of windings and electrostatic charging. However, it turned out that the problem of a good drafting ability and of wear were not satisfactorily solved. In addition, as a consequence of the adhesion the changing of the outer layer is expensive.

SUMMARY

The invention has the problem of eliminating these disadvantages and of finding a roller covering that has high wear resistance and long-lasting elasticity in the running layer and thus ensures optimal drafting conditions for a long time. Additional objects and advantages of the invention will be set forth in part in the following description, or may be obvious from the description, or may be learned through practice of the invention.

It surprisingly turned out that it is important in a multi-layer covering with a thin outer layer and a thicker inner layer that a relative movement can take place between the two layers. The milling motion of the soft covering and the tension forces produced thereby are then transferred only onto the inside of the outer, thin-walled layer but not on the fibers and the fluted cylinder. Practically no wear occurs any more, in particular no groove formation (shrinking), so that the outer layer has a service life that is more than three times longer than certain prior devices discussed above.

The outer layer is advantageously adapted on its outside as a fiber contact surface to the requirements of a good fiber clamping and on its inside as a running surface to the smoothest possible, low-friction running of the pressure roller. This is achieved, e.g., in a simple manner by the selection of appropriate material compositions for the fiber contact layer and the running layer of the outer layer. This outer layer can be designed as the casing around the inner pressure roller layer as well as an endless belt. It must only be so flexible that it adapts to the deformation of the soft inner layer. It proved to be especially advantageous to design the outer layer in the direction of travel of the fiber structure, that is, transversely to the roller axis, as inelastically as possible, that is, with the lowest possible extensibility. The tension forces in the clamping surface producing wear and acting negatively on the drafting are eliminated in this manner, whereas the outer layer can adapt in the axial direction to the rugosities of the fiber structure. An excellent clamping is achieved in this manner. The desired reduction of the expansion of the outer layer transversely to the axis of the pressure roller is achieved quite well by a yarn insert without limiting the expandability in the direction of the roller axis. The relative motion between the outer layer and the inner layer is favored by the smoothest possible surface of the running layer of the outer layer, and as a consequence thereof the breakdown of the tension forces is furthered in an even better manner.

It is advantageous for a high delivery speed to use an outer layer designed as a belt and to run this belt through a deflection rail. In addition, this deflection rail can also comprise side rims for a more reliable guidance. It also proved to be especially advantageous at high delivery speeds for a trouble-free travel if the belt rolls off the pressure roller at an angle $\alpha>30°$ to the plane of the fiber structure. The belt advantageously consists of several layers and the inside is designed as a smooth travel layer and the outside as a fiber contact layer. A yarn insert is provided between the layers which prevents the belt from expanding in the direction of travel without adversely influencing a desired transverse expansion.

Further details of the invention are explained using the figures.

DESCRIPTION

Figure 2:
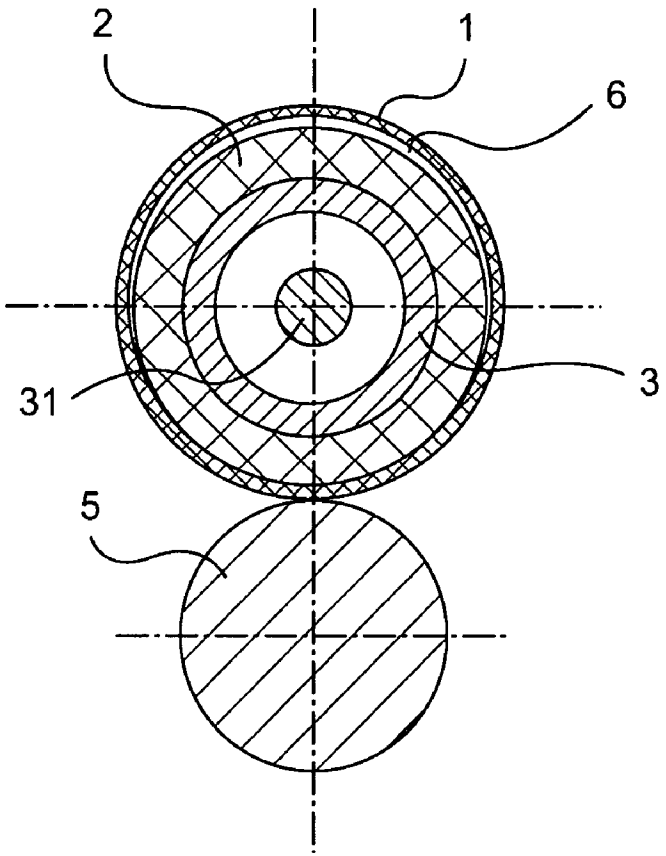
FIG. 2 shows a cross section through the device according to FIG. 1.

Reference is now made in detail to embodiments of the invention, one or more examples of which are illustrated in the drawings. Each embodiment is provided by way of explanation of the invention, and not as a limitation of the invention. For example, features illustrated or described as part of one embodiment may be used with another embodiment to yield still a further embodiment.

Figure 1:
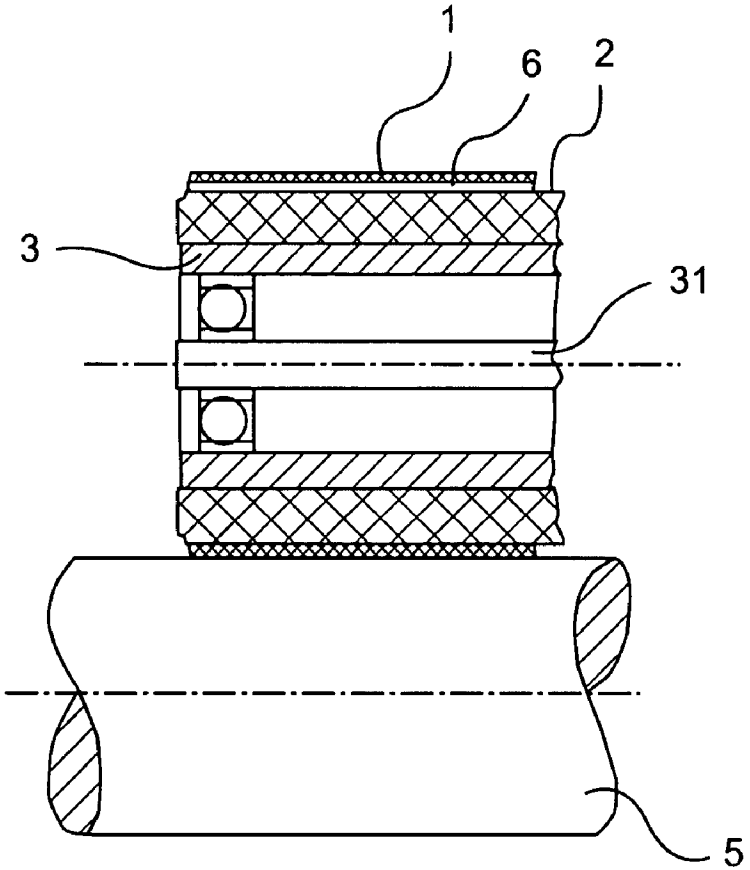
FIG. 1 shows the design of the two-layer roller covering in longitudinal section in accordance with the invention.

In FIGS. 1, 2 pressure roller 3 is arranged above drafting device cylinder 5 and comprises covering 2 permanently connected in a customary manner to pressure roller 3. Drafting device cylinder 5 and pressure roller 3 form the exit roller pair of a drafting device running at a high speed in accordance with the delivery. Another coating 1 is provided as an outer layer over this inner layer coating 2 of pressure roller 3. This outer layer consists in the embodiment shown here of thin-walled casing 1 consisting of flexible material that behaves practically without expansion relative to the material of inner layer 2 in the direction of travel of casing 1. This casing 1 is slipped loosely over inner layer 2 of pressure roller 3 so that intermediate space 6 can form in the non-loaded area between inner and outer layers. It is essential that casing 1 can move relative to inner layer 2 of pressure roller 3. On the other hand, inner layer 2 is drawn firmly onto pressure roller 3, as is customary. Under the loading of pressure roller 3 soft inner layer 2 is pressed onto drafting device cylinder 5 and deformed, so that no linear contact with drafting device cylinder 5 takes place but rather an area or planar support takes place. Since outer layer 1 is thin and flexible, it adapts to the deformation of inner layer 2 without being substantially compressed itself. Therefore, in contrast to the inner layer, no appreciable pressing work is performed in the case of outer layer 1. The clamping surface generated by the deformation of inner layer 2 is transmitted by outer layer 1 so that fiber structure F (FIG. 6) provided for the drafting is clamped by this clamping surface when passing through roller pair 3, 5.

In the customary pressure roller coverings, a clamping surface is formed by the soft elastic covering which surface produces a good clamping action. However, tension forces are produced in the area of the clamping surface by the pressing work of the covering that have a negative effect on the fiber structure during drafting and also cause the known high wear of the covering. However, the arrangement of an outer layer 1 that flexibly adapts to the deformation of soft and elastic covering 2 of pressure roller 3, but that causes no or only a very low pressing work on account of its lower thickness and deformability, surprisingly led to the result that this outer layer 1 exhibits a significantly greater stability and also the soft inner layer 2 displays none of the customary phenomena of wear and shrinking. It turned out in extensive tests that outer layer 1 still ran without any problems even after three times the run time and did not have to be replaced. The drafting values were even able to be improved compared to new traditional coverings. It is to be assumed that this surprising result can be traced to the fact that the tension forces conditioned by the pressing work of soft and elastic inner layer 2 of pressure roller 3 can not affect the clamped fiber structure. These tension forces are degraded by the relative motion that is possible between soft inner layer 2 and smooth run layer 102 (FIG. 4) of outer layer 1. No relative movement takes place between the fibers and drafting device cylinder 5 as well as outer layer 1 so that the clamping takes place in the area of static friction. Thus, no wear caused by sliding can occur.

Figure 3:
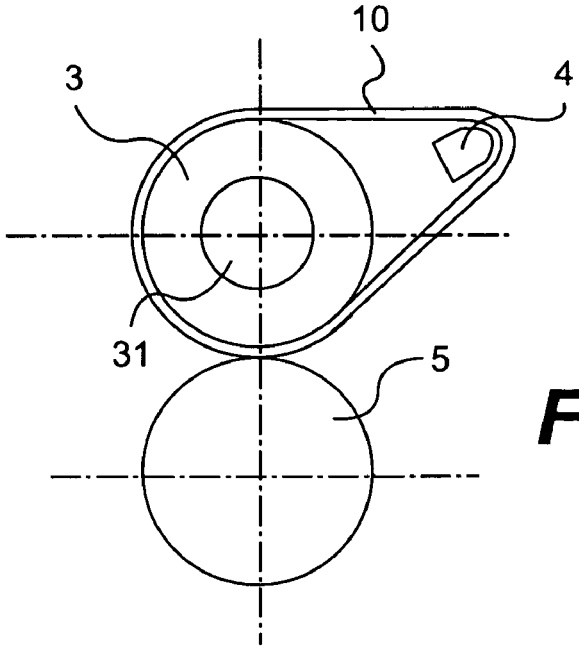
FIG. 3 shows the design of the outer layer as belt.

In the exemplary embodiment according to FIGS. 1, 2 the outer layer is designed as cylindrical casing 1. However it can also be designed as a rather long endless belt. This cylindrical casing 1 as well as a belt 10 or 100 can be readily replaced in case of wear or the formation of grooves in the area of fiber structure F. FIG. 3 shows endless belt 10 that surrounds pressure roller 3 with its soft elastic inner layer 2 and is guided by deflection rail 4. The construction as a rather long endless belt 10 or 100 and its guidance by deflection rail 4 proved to be particularly advantageous when the device is run at high delivery speeds.

It should be taken into consideration that, depending on the particular draft, drafting devices 3, 5 forming the delivery roller pair run approximately 20 to 30 times more rapidly than the roller pairs arranged in front of the main drafting field, that are customarily surrounded by fiber guide belts. These known fiber guide belts proved to be unsuitable for being used as outer layer 1 on exit roller pair 3, 5. These belts are insufficient in their properties. Thus, it turned out, e.g., that it is important that outer layer 1 or belt 10 or 100 is as inelastic as possible in the direction of travel of fiber structure F, that is, transversely to roller axis 31, so that it can not expand.

Of course, not every expansion can be eliminated in the physical sense but it should be as small as possible. This achieved in a simple manner by yarn insert 103. Furthermore, the known belts favor the sliding of the fibers during drafting, which is undesired for the exit roller pair.

Figure 4:
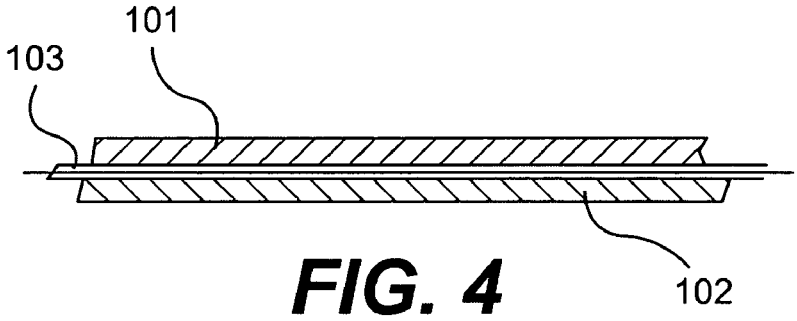
FIGS. 4, 5 schematically show the design of the outer layer with an insert for stiffening in the direction transverse to the cylinder axis.

FIG. 4 shows the design of outer layer 1, 10 or 100 in section, that is directed specifically toward these desired properties. The outer layer designed as casing 1 or lengthened endless belt 10 or 100 is advantageously composed of several layers: Of fiber contact layer 101 and of run layer 102. Yarn insert 103 is arranged between both layers 101, 102 for eliminating the expansion in the longitudinal direction, which insert is firmly connected to fiber contact layer 101 and also to run layer 102. Fiber contact layer 101 is designed in its surface and in its material in contact with fiber structure F for receiving the retention forces necessary during drafting. This is achieved, e.g., by using a material like the one used for pressure roller coverings. On the other hand, run layer 102 is provided with a smooth surface favoring sliding, in order to make possible a relative motion relative to outer layer 100, 10 or 1 around inner layer 2. A material favoring sliding is preferably used for run layer 102 like the material used, e.g., for the known belts for fiber guidance in the main drafting field.

Yarn insert 103 takes the elasticity from belt 100 in the direction of travel so that an expansion is practically not possible. However, the expandability remains transversely to the direction of travel, that is, in the direction of pressure roller axis 31. The belt can adapt to the rugosities of drafted fiber structure F so that a good clamping is always ensured. In spite of these multi-layers of the outer layer, the latter must naturally not be too thick in order to impart good flexibility to it for adaptation to the deformation of inner layer 2 and to fiber structure F. A total thickness of 0.8 to 1.0 mm has proven to be especially advantageous in this connection as regards the stability and also the drafting results. No groove formation (shrinkage) could be determined even after several years of run time.

The desired properties of run layer 102 and a fiber contact layer 101 can also be achieved by an appropriate physical shaping of the surfaces. However, run layer 102 and fiber contact layer 101 preferably consist of different materials that have the desired sliding properties and the necessary grip. Measurements according to DIN 53375 have shown that e.g., the above-described material for fiber contact layer 101 has a frictional force value that is at least twice as high as the frictional force value of run layer 102 when the latter consists of a material like that used for belts for fiber guidance in the main drafting field. Run layer 102 thus has good sliding properties while fiber contact layer 101 achieves an excellent clamping of the fibers.

Figure 5:
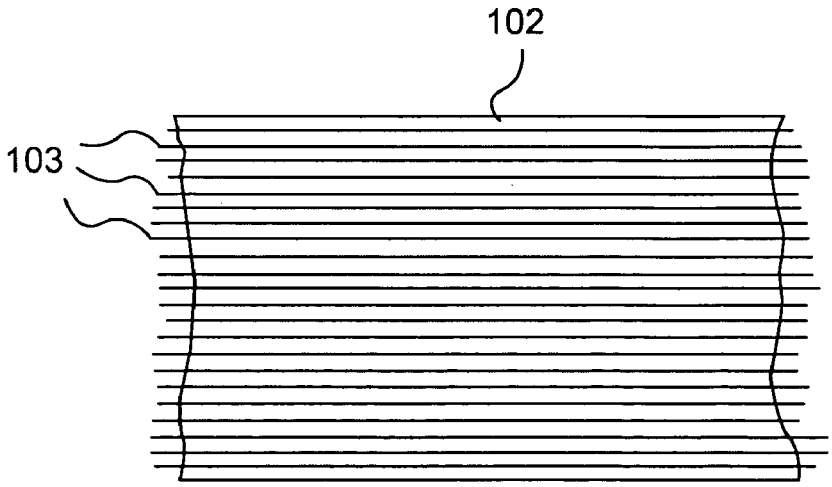

The manufacture of such an endless belt in accordance with FIGS. 4,5 takes place, e.g., in such a manner that at first run layer 102 is applied onto a tubular body with a circumference corresponding to the length of the belt, onto which run layer a yarn is wound that forms yarn insert 103. Then, this yarn insert 103 is covered with fiber contact layer 101.

Figure 6:
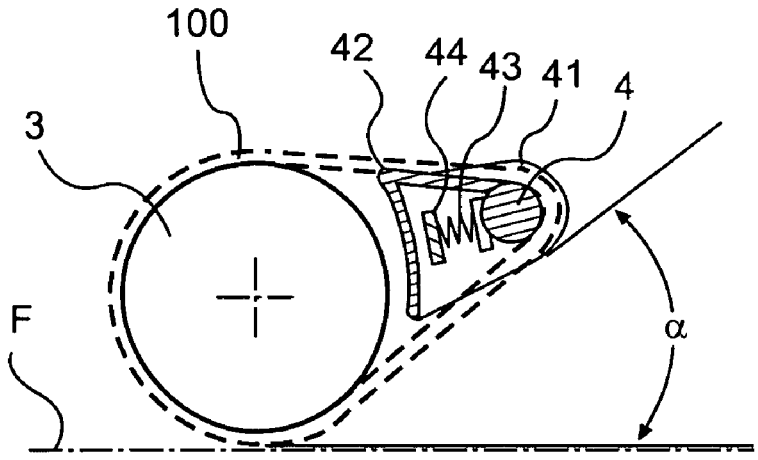
FIG. 6 shows in section the guidance of the belt by means of a deflection rail.
Figure 7:
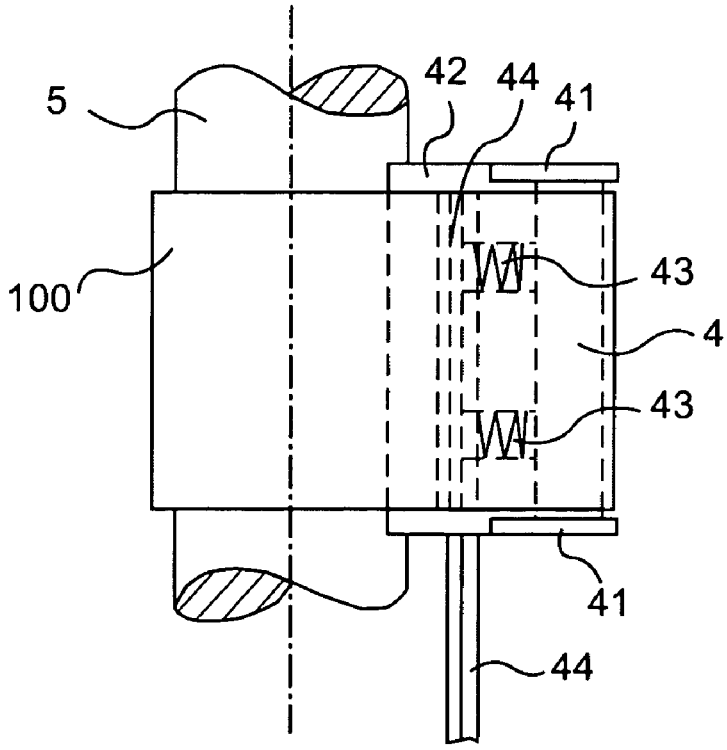
FIG. 7 shows a plan view accompanying FIG. 6

In the embodiment according to FIGS. 6, 7 a belt 100 is run through deflection rail 4. In order to ensure a light run of belt 100, deflection rail 4 is not only rounded but additionally provided with a low-friction coating. Cage 42 with guide rims 41 follows this deflection rail 4. The space between deflection rail 4 and drafting device roller 3 is encapsulated by this cage 42 and its guide rims 41, so that collections of fluff in this space are avoided. Belt 100 runs from drafting device roller 3 at an angle $\alpha$ relative to the plane of fiber structure F. This avoids turbulence and fly formation in the exit area of fiber structure F. Cage 42 is supported on holding rail 44 via pressure springs 43 so that deflection rail 4 exerts a tension on belt 100. Side rims 41 serve to laterally guide belt 100. An easy and rapid replacement of belt 100 is also possible in this embodiment. Belt 100 is relieved by pressing deflection rail 4 back and can also be readily lifted over side rims 41. These side rims 41 also serve in addition to encapsulating the space between pressure roller 3 and deflection rail 4 for the lateral guiding of belt 100. If outer layer 1 of pressure roller 3 is arranged asymmetrically to fiber structure F, outer layer 1 can be turned so that the left side is located on the right side and thus fiber structure F runs over an unused surface of the outer layer.

It should be appreciated by those skilled in the art that various modifications and variations can be made to the embodiments of the invention described herein without departing from the scope and spirit of the claims or their equivalents.

The invention claimed is:

1. A spinning machine drafting device, comprising:

a roller pair including a pressure roller loaded against a lower roller such that a fiber structure is conveyed between said roller pair for drafting;

an inner layer of a deformable flexible material attached completely around the circumference of said pressure roller without relative movement between said inner layer and said pressure roller;

an outer circumferential layer of a generally inelastic material disposed around at least a portion of the outer circumference of said inner layer, said outer layer being thinner than said inner layer and disposed around said inner layer so as to slide relative to said inner layer upon rotation of said pressure roller in operation of said drafting device.

2. The drafting device as in claim 1, wherein said outer layer comprises a casing that completely surrounds said inner layer.

3. The drafting device as in claim 1, wherein said outer layer comprises an endless belt that runs in a traveling direction around a circumferential portion of said pressure roller.

4. The drafting device as in claim 1, wherein said outer layer comprises an inner run material disposed against said inner layer, and an outer fiber contact material that contacts a fiber structure conveyed between said roller pair.

5. The drafting device as in claim 4, wherein said inner run material is formed of a smooth low friction material to facilitate relative sliding movement between said outer and inner layers.

6. The drafting device as in claim 5, wherein said outer layer comprises substantially no expansion in a direction transverse to the rotational axis of said pressure roller.

7. The drafting device as in claim 6, further comprising an insert material disposed between said inner run material and said outer fiber contacting material, said insert material formed of a material to minimize expansion of said outer layer in the direction transverse to the rotational axis of said pressure roller.

8. The drafting device as in claim 5, wherein said outer fiber contacting material is formed of a high frictional material as compared to said inner run material to facilitate clamping of a fiber structure.

9. The drafting device as in claim 1, wherein said outer layer comprises an endless belt that runs in a traveling direction around a circumferential portion of said pressure roller, and further comprising a deflection rail disposed to guide said endless belt in said traveling direction.

10. The drafting device as in claim 9, wherein said deflection rail comprises a rounded surface formed of a low friction material in an area where said endless belt contacts and is deflected by said deflection rail.

11. The drafting device as in claim 9, wherein said deflection rail is resiliently mounted so as to apply a tensioning force to said endless belt.

12. The drafting device as in claim 9, wherein said deflection rail comprises lateral side rims for lateral guidance of said endless belt.

13. The drafting device as in claim 12, wherein said lateral sides rims are configured to encapsulate space between said deflection rail and said pressure roller and surrounded by said endless belt.

14. The drafting device as in claim 9, wherein said endless belt is guided at an angle away from a running plane of the fiber structure at an angle of greater than about 30 degrees with respect to the running plane of the fiber structure.

15. The drafting device as in claim 9, wherein said endless belt comprises an outer fiber contacting material having dimensions so as to be asymmetric relative to the dimensions of the fiber structure so that an unused portion of said outer fiber contacting material is provided in use of said drafting device, wherein said endless belt is repositioned to bring said unused portion into contact with the fiber structure.

16. An outer layer component for use in a covering combination over a pressure roller of a pair of rollers in a drafting device for spinning machines, wherein the covering combination includes an inner layer formed of a flexible and deformable material disposed entirely around the pressure roller with essentially no relative movement between the pressure roller and inner layer, and the outer layer component is disposed around at least a portion of the circumference of the inner layer and slides relative to the inner layer upon rotation of the pressure roller in operation of the drafting device, said outer layer component formed from a generally inelastic material and being thinner than the inner layer said covering comprising substantially no expansion in a direction transverse to the rotational axis of said pressure roller.

17. The outer layer component as in claim 16, wherein said component is a casing configured to fit completely around the pressure roller.

18. The outer layer component as in claim 16, wherein said component is an endless belt that runs in a traveling direction around a circumferential portion of the pressure roller.

19. The outer layer component as in claim 16, comprising an inner run material disposed to lie against the inner layer of the covering combination, and an outer fiber contact material that contacts a fiber structure conveyed against the pressure roller.

20. The outer layer component as in claim 19, wherein said inner run material is formed of a smooth low friction material to facilitate relative sliding movement between said outer and inner layers.

21. The outer layer component as in claim 19, further comprising an insert material disposed between said inner run material and said outer fiber contacting material, said insert material formed of a material to minimize expansion of said outer layer in the direction transverse to the rotational axis of the pressure roller.

22. The outer layer component as in claim 19, wherein said outer fiber contacting material is formed of a high frictional material as compared to said inner run material to facilitate clamping of a fiber structure.

23. The outer layer component as in claim 22, wherein said inner run material has a frictional value of about one-half the frictional value of said outer fiber contacting material.

24. The outer layer component as in claim 16, wherein said component is an endless belt that runs in a traveling direction around a circumferential portion of the pressure roller, said endless belt comprising an outer fiber contacting material having dimensions so as to be asymmetric relative to the dimensions of the fiber structure so that an unused portion of said outer fiber contacting material is provided in use of said drafting device, wherein said endless belt is repositioned to bring said unused portion into contact with the fiber structure.

25. A method for manufacturing the outer layer component of claim 21, comprising applying the inner layer onto a tubular body having a circumference equal to a desired inner circumferential dimension of the endless belt, applying the insert material in the form of a yarn wrapped over the inner layer; applying the outer layer over the yarn insert material; and removing the endless belt from the tubular body.

* * * * *